US005737962A

United States Patent [19]

Turner et al.

[11] Patent Number: 5,737,962

[45] Date of Patent: Apr. 14, 1998

[54] STEAM DELIVERY SYSTEM FOR STATIC TESTING OF GAS DRIVEN TORPEDOES

[75] Inventors: Stephen E. Turner, Newport; Peter A. Roy, Warwick, both of R.I.

[73] Assignee: The United States of America as represented by the Secretary of the Navy, Washington, D.C.

[21] Appl. No.: 682,877

[22] Filed: Jul. 31, 1996

[51] Int. Cl.[6] ..... G01M 19/00

[52] U.S. Cl. ..... 73/167; 73/866.4

[58] Field of Search ..... 73/167, 865.7, 73/865.6, 866.4

[56] References Cited

U.S. PATENT DOCUMENTS

| | | | |
|---|---|---|---|
| 1,131,341 | 3/1915 | Dieter | 137/505.13 |
| 1,134,039 | 3/1915 | Dieter | 73/167 X |
| 2,617,703 | 11/1952 | Minkler | 73/167 X |
| 2,649,750 | 8/1953 | Burgess, Jr. | 73/167 X |
| 2,807,164 | 4/1957 | Rumbough | 73/167 |
| 2,971,325 | 2/1961 | Gongwer | 60/211 |
| 3,109,401 | 11/1963 | Karig | 114/20.2 |
| 3,730,121 | 5/1973 | Supernal | 324/601 X |
| 3,752,429 | 8/1973 | Reed | 248/179.1 |
| 3,962,671 | 6/1976 | Jilling | 73/1 DV X |
| 4,680,934 | 7/1987 | Short | 60/652 |
| 4,756,264 | 7/1988 | Ewbert | 114/20.1 |
| 5,117,635 | 6/1992 | Blou | 60/668 |
| 5,592,850 | 1/1997 | Rowan | 73/865.6 |

*Primary Examiner*—Thomas P. Noland

*Attorney, Agent, or Firm*—Michael J. McGowan; Robert W. Gauthier; Prithvi C. Lall

[57] ABSTRACT

A torpedo is provided in a static test fixture where the engine, normally driven by the combustion of otto fuel is driven from a land based source of superheated steam. The torpedo's otto fuel engine is operated on steam and the need for a combustor and other fuel related components is eliminated. Such components are replaced by a steam line and a steam adapter. The torpedo's fuel tank is replaced with an extender section where the steam supply is connected and fed to the steam adapter. The need for storing combustible fuel and oxidizer agents on site is eliminated. The usual support and safety equipment required for handling of otto fuel and explosive devices are also eliminated.

7 Claims, 4 Drawing Sheets

STEAM DELIVERY SYSTEM FOR STATIC TESTING OF GAS DRIVEN TORPEDOES

STATEMENT OF GOVERNMENT INTEREST

The invention described herein may be manufactured and used by and for the government of the United States of America for governmental purposes without the payment of any royalties thereon or therefore.

BACKGROUND OF THE INVENTION

1. Field of the Invention

The present invention relates to static testing of gas driven torpedoes, and deals more specifically with a steam delivery system for operating the torpedo's gas driven engine and drive system from a remote source of superheated steam.

2. Description of the Prior Art

Steam driven torpedoes have been known for some time, and U.S. Pat. No. 1,131,341 issued to Dieter in 1915 shows a self-contained steam powered torpedo that is driven by a turbine which turbine has hot steam provided thereto in an open system that does not provide for recovery of the steam.

U.S. Pat. No. 2,971,325 issued to Gongwer in 1961 shows a jet propulsion system for operating a submerged vehicle with the working fluid being hot steam that is generated on board the vehicle. The propulsion jet is formed by a combination of steam and the mass of the surrounding sea water to propel the torpedo through the water.

U.S. Pat. No. 3,109,401 issued to Karig in 1963 shows a closed loop torpedo power plant where propulsion is provided from a source of heat within the vehicle in a closed steam system which allows for recovery of the condensed steam.

U.S. Pat. No. 4,680,934 issued to Short in 1987 shows a novel boiler arrangement on board the torpedo to generate the heat required for a closed steam or other fluid system.

U.S. Pat. No. 4,756,264 issued to Ewbank in 1988 shows a self-contained steam driven system for powering a torpedo, wherein the boiler and the condenser of the closed steam system are constructed to be quieter than prior art closed steam systems.

U.S. Pat. No. 5,117,635 issued to Blau in 1992 shows an open Rankine cycle power system for underwater use. This system utilizes a steam generator, a turbine, pumps and other apparatus to provide and control the flow of sea water which is the working fluid, and a mixing condenser to condense the spent steam.

Current propulsion systems of torpedoes in use today require a combustible fuel, such as otto fuel, to produce hot gas at sufficient pressure for expansion against pistons or turbines provided in the torpedo's conventional propulsion system. Such a fuel delivery system requires storage of a suitable fuel inside the torpedo, a fuel pump, a fuel metering valve, and a combustor which converts the liquid fuel into the hot gas required for propulsion. Land based testing of torpedo propulsion systems using such fuel requires extensive support equipment to ensure the safety of personnel and to prevent damage to the environment.

While the prior art patents show the use of steam to power a torpedo's engine, they do not suggest the use of steam from a remote source to power an otherwise conventional combustible fuel engine propulsion system in a static test arrangement for operating a torpedo such as the MK46 for example. There exists a need for an economical land based testing arrangement for a torpedo's propulsion system, which facilitates the collection of radiated sound data due to vibration and other self-generated noise sources within a modern torpedo propulsion system without requiring the extensive support equipment to operate the torpedo's conventional propulsion system in a land based test environment.

SUMMARY OF THE INVENTION

Accordingly, it is the general purpose and object of the present invention to provide an improved static testing system for gas driven torpedoes, and more particularly to provide for the use of superheated steam to operate the normally combustible fuel driven engine of such a torpedo in order to facilitate testing of the torpedo's engine particularly from the point of view of radiated sound, self-generated noise, vibration, and subsystem testing generally, including that of verifying test fixture parameters.

This object is accomplished with the present invention by substituting a steam delivery system for the hot gas propulsion normally provided to the combustor in such a torpedo. The steam is provided directly to the engine itself for static testing of the mechanical components in a torpedo propulsion system. The torpedo is provided in a static test fixture, which may be in air or submerged water, and the combustor or gas generating portion of the torpedo is removed. The fuel tank portion of the torpedo can also be removed and an extender section substituted therefore.

The combustor or gas generating component of the submarine's propulsion system is replaced by a unique adapter that connects a remote source of steam under pressure to the engine for driving its propulsion system. As so constructed and arranged, the torpedo's gas engine can be driven from hot steam rather than requiring combustible gases to be generated within the torpedo from fuel fed either remotely to the torpedo or stored in its fuel tank section.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
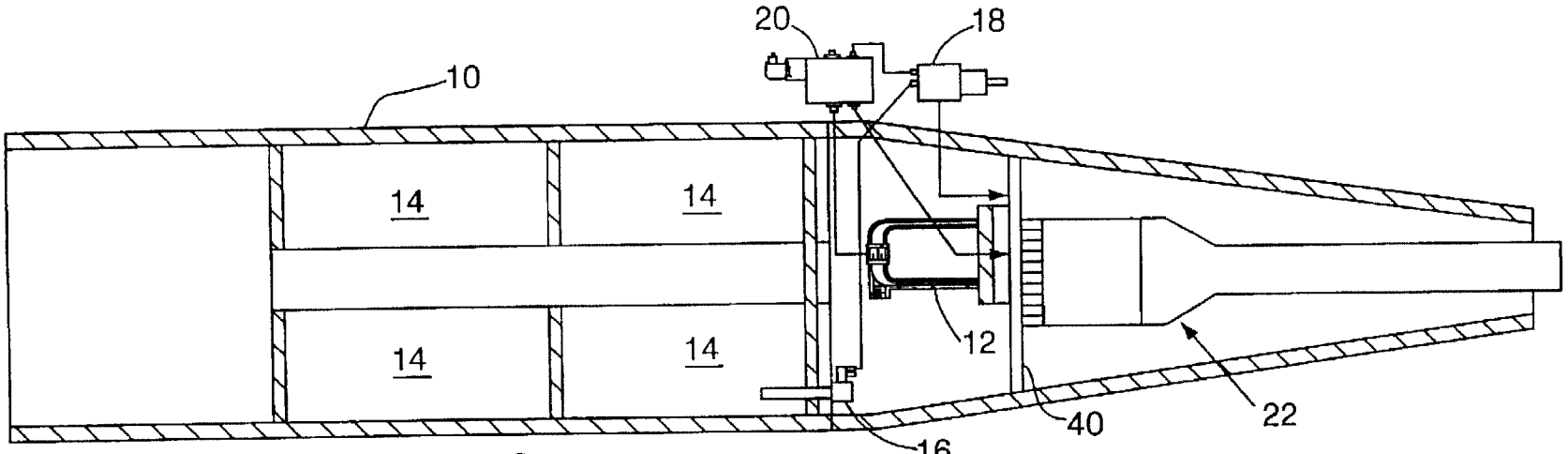
FIG. 1 PRIOR ART
FIG. 1 shows a prior art static testing set up wherein otto fuel is provided to a MK46 torpedo, the torpedo being shown in section with portions omitted for clarity.
Figure 2:
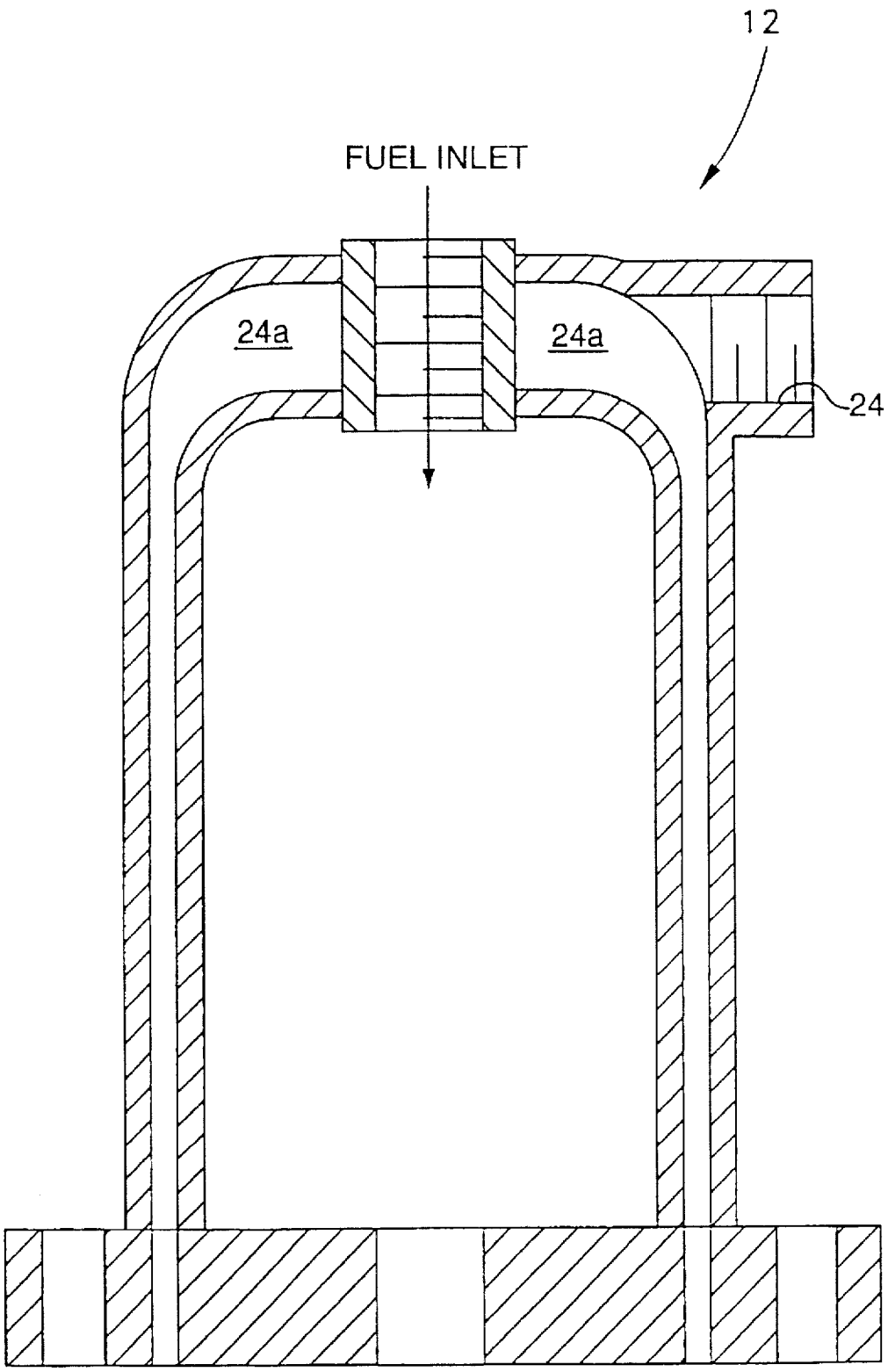
FIG. 2 PRIOR ART
FIG. 2 is a detailed view of the prior art combustor illustrated in FIG. 1.

Turning now to the drawings in greater detail, the conventional static test set up of FIG. 1 provides for mounting a conventional MK46 torpedo, the afterbody and tailcone section being shown generally at 10, in a test fixture (not shown) and delivering to the torpedo combustor 12 a supply of otto fuel stored in the torpedo's fuel tanks 14. In a static test fixture, fuel from the fuel tanks is routed through an interlock valve 16 to a fuel pump 18 and thence through the two-speed valve 20 so as to be provided at the inlet end of the combustor 12, as shown in greater detail in FIG. 2. Cooling water must be provided to the combustor 12 as the combustible gases generate considerable heat to provide sufficient energy for operating the torpedo's gas driven engine, indicated generally at 22 in FIG. 1. FIG. 2 shows the combustor 12 as having coolant inlet 24 and coolant passageways 24*a*. Passageways 24*a* extend through combustor 12 and into engine 22 to provide cooling required for static test operations.

All of these components, that is the combustor 12, the two-speed valve 20, the fuel tanks 14, the interlock valve 16, the fuel pump 18 and the associated plumbing required to connect these components, lead to the requirement for support equipment to ensure the safety of personnel, and to prevent damage to the environment when the torpedo is to be static tested according to the prior art teaching of FIGS. 1 and 2.

In accordance with the present invention, the above listed components are eliminated in favor of a source of steam at relatively high pressure and temperature (not shown) that may be provided at a remote location from torpedo 10 itself. This steam is provided to the torpedo through a steam delivery pipe indicated generally at 26 in FIG. 3. The steam is preferably provided to an extender section 28 of torpedo 10 that is substituted for the fuel tank section 14 of FIG. 1 referred to previously. For the safety of personnel and to avoid damage to the environment, a rupture disk and relief valve 30 may be provided on this extender section in the event that hot steam has to be vented rather than being delivered through the flexible line 32 to a steam inlet adapter 34. The steam inlet adapter 34 is provided in place of the combustor 12 in the static test set up of FIG. 1.

Figure 3:
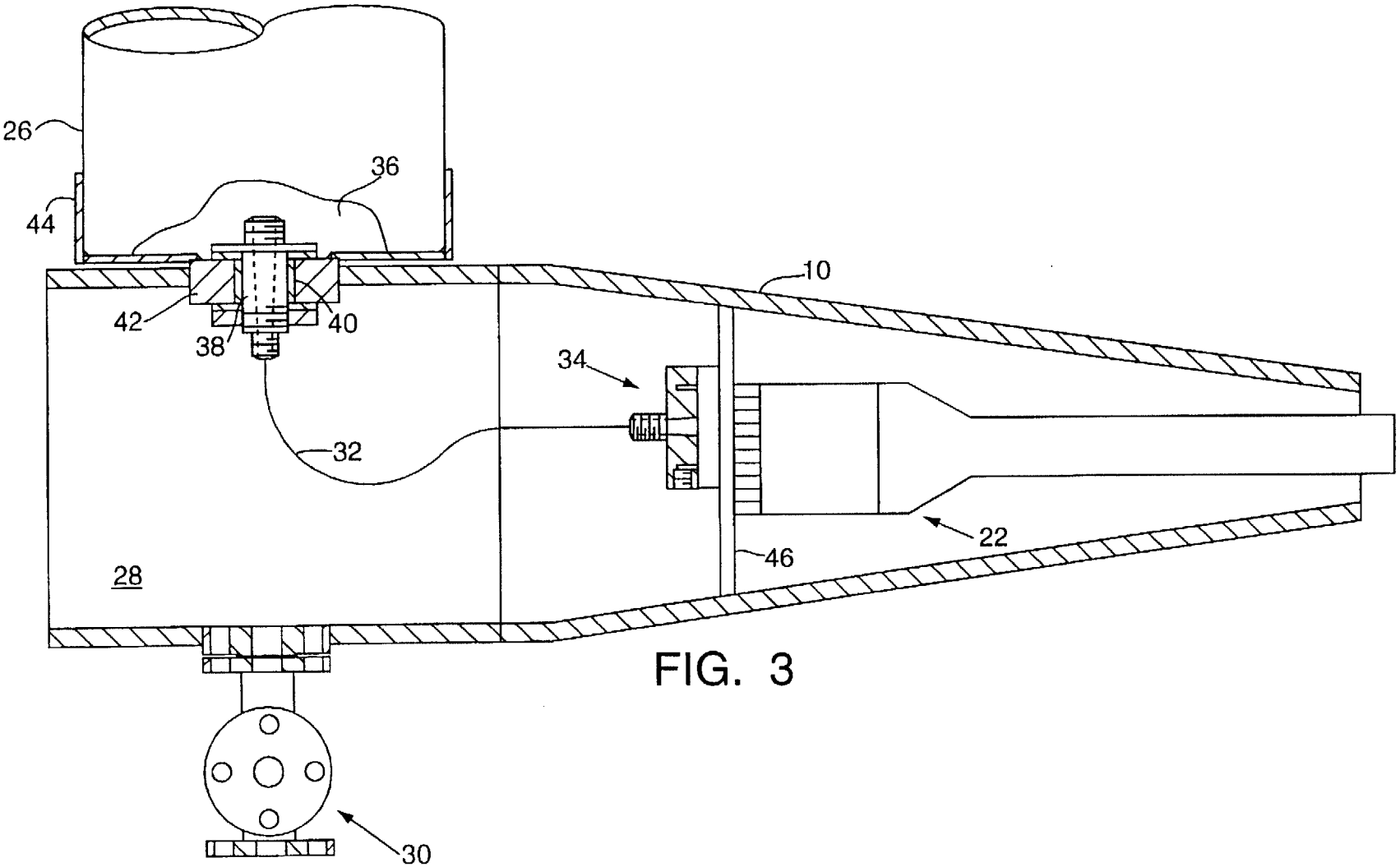
FIG. 3 is a section of the torpedo with portions broken away revealing the steam delivery system of the present invention provided in place of the conventional combustor and associated components as depicted in FIG. 1.

By way of comparison as between FIG. 1 and FIG. 3, it will be apparent that in FIG. 3, the source of steam may be located remotely from the torpedo. The flexible line 32 and adapter 34 replace the combustor 12, the two-speed valve 20, the fuel tanks 14, the interlock valve 16, the fuel pump 18 and the associated plumbing and other support equipment required heretofore.

The improved steam delivery system of FIG. 3 includes the extender section 28 that replaces the fuel tank section 14 of the torpedo from FIG. 1 as mentioned previously. The extender section 28 preferably includes a steam pass-through 36. This steam pass-through 36 comprises a custom stainless steel reducing union 38 which fits into an alumina-silica insulating sleeve 40. The sleeve in turn fits inside an aluminum block 42 which is welded to the extender section 28. Internally, this union defines a steam flow passageway which reduces the flow area in a gradual fashion in order to minimize noise and pressure drop. An aluminum shroud 44 is welded to the external surface of the aluminum block 42 to provide a seal for the relatively large diameter pipe 26 that serves as the steam supply line with the necessary insulation.

Figure 4:
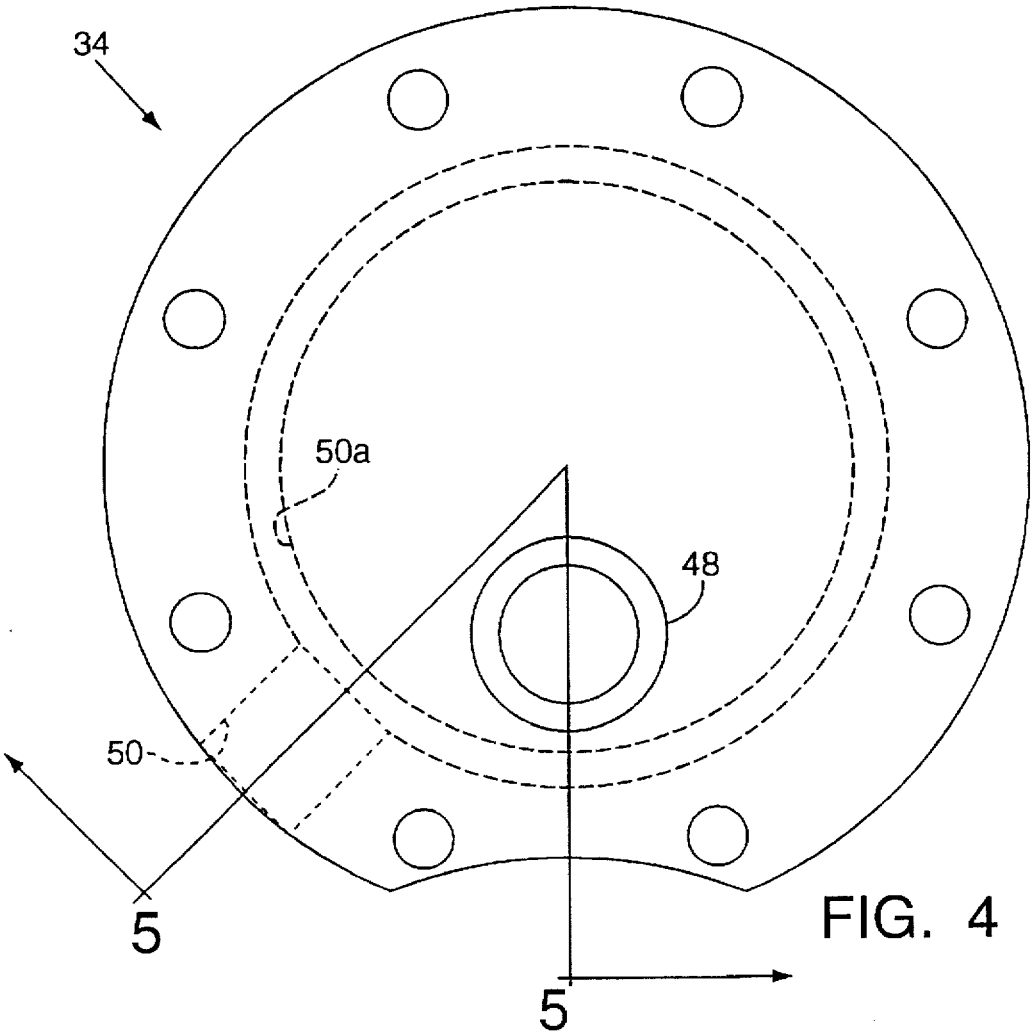
FIG. 4 is a plan view of the adapter provided in place of the combustor in FIG. 3.
Figure 5:
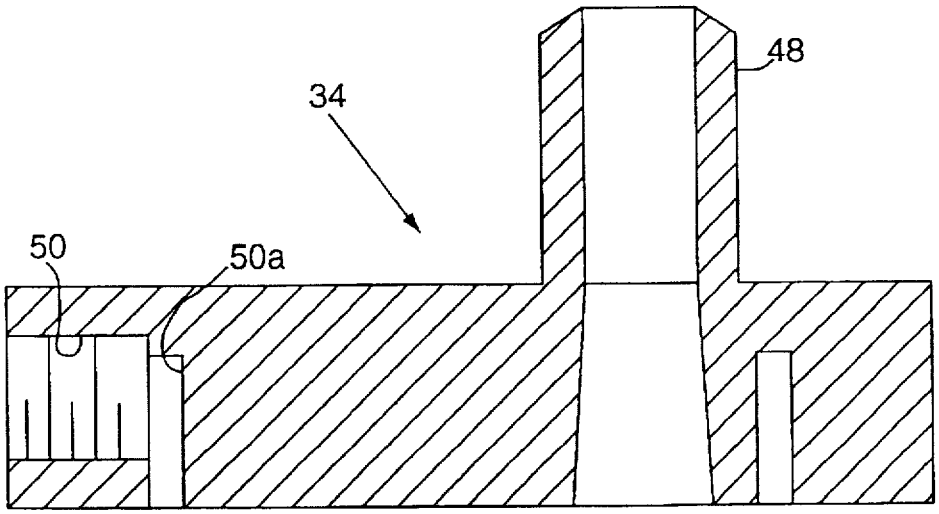
FIG. 5 is a sectional view taken generally on the line 5—5 of FIG. 4.

The flexible line 32 provides for delivering the hot steam to the steam inlet adapter 34 and is also preferably fabricated from a stainless steel material. This line is provided with conventional connectors or fittings at each end to achieve the same flow area to match that in the inlet adapter 34 which is provided in the accessory bulkhead 46. The steam inlet adapter 34 is shown in greater detail in FIGS. 4 and 5 to comprise not only the steam inlet 48 to replace the combustion gas inlet of the combustor 12 (not shown in FIG. 2), but also includes a cooling water inlet 50 that provides cooling water to components of the gas propulsion engine of the torpedo that may require such cooling through circular slot 50*a* corresponding to passageways 24*a* of combustor 12.

What has thus been described is a steam delivery system for static testing of torpedo engines which replaces the hot gas normally driving the engine. The combustor, where the normal engine fuel, such as otto fuel, is combusted to form the hot gas is replaced by a steam inlet adapter. The fuel tank section of the torpedo is replaced by an extender section having a steam pass through and a rupture disk and relief valve assembly. A source of steam is connected to the pass through. The pass through has a large diameter collar for accepting an insulated steam line and further has a gradual reducing union which feeds the steam through a small diameter tube to the steam inlet adapter.

The above described static test system for gas engine driven torpedoes has many advantages as outlined previously. Not only is the safety of the installation enhanced by the use of remotely generated superheated steam, but noise testing of the torpedo, including its mechanical drive system is rendered much more feasible, and is accomplished with greater safety and at considerably less expense than has been possible heretofore.

Obviously, many modifications and variations of the present invention may become apparent in light of the above teachings. For example, the exact shapes and configurations of the particular components shown can be changed to suit manufacturing and assembly considerations, as well as being adapted for the specific torpedo and engine being tested. The shroud can be configured to suit the steam supply line at the test site and can also be adapted to include a quick disconnect fitting.

In light of the above, it is therefore understood that within the scope of the appended claims, the invention may be practiced otherwise than as specifically described.

What is claimed is:

1. A system for static testing torpedoes of the type having a propulsion engine that is normally driven by relatively hot gas products of combustion generated inside the torpedo, said system comprising:

a source of steam provided externally of the torpedo; and steam delivery means for providing steam at appropriate temperatures and pressures to the torpedo's propulsion engine for operating that engine from hot steam rather than from the hot gas products of combustion.

2. The system according to claim 1, wherein said steam delivery means further comprises a steam inlet adapter located internally of the torpedo at a point normally occupied by a conventional gas combustor of the torpedo's propulsion engine.

3. The system according to claim 1, wherein said steam delivery means further comprises:

an external steam delivery pipe; and an internal steam delivery line, the external steam delivery pipe having a substantial cross-sectional size in relation to a reduced cross-sectional size of the internal steam delivery line.

4. The system according to claim 3 further comprising a reducing union between said steam delivery pipe and said reduced cross-sectional delivery line.

5. The system according to claim 4 further comprising a shroud around said steam delivery means.

6. The system according to claim 5 further comprising an extender section provided in the torpedo in place of a fuel tank normally provided in the torpedo.

7. A system for static testing torpedoes of the type having a propulsion engine that is normally driven by relatively hot gas products of combustion generated inside the torpedo, said system comprising:

a source of steam provided externally of the torpedo;

steam delivery means for providing steam at appropriate temperatures and pressures to the torpedo's propulsion engine for operating that engine from hot steam rather than from the hot gas products of combustion;

an external steam delivery pipe and shroud at a junction between said torpedo and said steam source;

an internal steam delivery line inside the torpedo, said steam delivery pipe having a substantial cross-sectional size in relation to a greatly reduced cross-sectional size of the internal steam delivery line;

a reducing union between said steam delivery pipe and shroud and said steam delivery line inside said torpedo;

a steam inlet adapter located internally of the torpedo at a point normally occupied by a conventional gas combustor of the torpedo's propulsion engine; and an extender section provided in the torpedo in place of a fuel tank normally provided to store fuel inside the torpedo.

* * * * *